US006568485B2

(12) United States Patent
Falgout, Sr.

(10) Patent No.: US 6,568,485 B2
(45) Date of Patent: May 27, 2003

(54) STALLED MOTOR BY-PASS VALVE

(76) Inventor: Thomas E. Falgout, Sr., 110 Charles Read St., Lafayette, LA (US) 70503

( * ) Notice: Subject to any disclaimer, the term of this patent is extended or adjusted under 35 U.S.C. 154(b) by 43 days.

(21) Appl. No.: 09/836,487

(22) Filed: Apr. 17, 2001

(65) Prior Publication Data

US 2002/0148645 A1 Oct. 17, 2002

(51) Int. Cl.[7] ..... E21B 4/02

(52) U.S. Cl. ..... 175/26; 175/93; 175/107

(58) Field of Search ..... 175/26, 48, 92, 175/93, 100, 107; 415/903

(56) References Cited

U.S. PATENT DOCUMENTS

| | | | | | |
|---|---|---|---|---|---|
| 3,983,948 | A | * | 10/1976 | Jeter | 175/45 |
| 4,491,186 | A | * | 1/1985 | Alder | 175/26 |
| 5,586,083 | A | * | 12/1996 | Chin et al. | 367/84 |
| 6,047,784 | A | * | 4/2000 | Dorel | 175/61 |
| 6,092,610 | A | * | 7/2000 | Kosmala et al. | 175/61 |

* cited by examiner

*Primary Examiner*—David Bagnell
*Assistant Examiner*—Zakiya Walker

(57) ABSTRACT

Between a drilling motor and the upwardly continuing drill string a housing contains a speed sensor rotationally connected to the motor rotor. Motor speed is sensed and if rotating at a rate less than a selected speed, a cooperating by-pass valve opens to shunt drilling fluid to the well annulus to prevent damage to the stalled motor.

20 Claims, 4 Drawing Sheets

STALLED MOTOR BY-PASS VALVE

This invention pertains to well drilling apparatus, more particularly to controls for down hole drilling motors. The preferred embodiment is used as part of the drill string, just above the motor to sense stall speed and to open a by pass channel to shunt drilling fluid around the stalled motor to the well annulus. In one configuration the by-pass channel is through a bore in the rotor of the motor.

BACKGROUND

Fluid powered drilling motors in common use are of the turbine type or positive displacement type. Turbine types can stall while drilling but the motor is usually not damaged as a result. Drilling motors of the positive displacement type, known as progressing cavity motors, have the ability to stall when overloaded and such stall conditions will, in time, damage the motor. The stalled condition does not stop the movement of fluid through the motor and damage to the elastomer stator often results if allowed to continue for some time. If the stall is sensed at the surface, the flow of drilling fluid can be stopped before damage occurs. One stall indicator is zero penetration of the drill head but that takes too long to recognize. Pressure drop through a stalled motor should increase enough for stall detection but motors are very often operated with torque near the stall condition and the pressure difference is often lost in the much higher pressure in the overall drilling fluid circuit. A positive indication of stall is needed and by-passing of the fluid around the motor to the well bore would give a positive signal in the form of a significant drop in stand pipe pressure at the surface. Further, by-passed drilling fluid would protect the motor to some extent even before the signal brings on corrective actions at the surface. The drill head can be lifted from the well face to allow the motor to restart and drilling can continue.

SUMMARY OF INVENTION

The apparatus is housed in a length of drill string that is installed in the drill string just above the motor. The drilling motor is a part of the drill string. The housing may be part of the motor body, or it may be a separate drill string element attached to the motor body. Drilling fluid flows through the housing from the drill string bore to the motor. In the housing a rotational control sensor is associated with a valve actuator that will be opened by the apparatus when the rotor of the motor is turning at less than a preselected speed. Several methods for rotor speed sensing are disclosed. Sensed orbital speed is an indirect indication of rotational speed.

One sensor utilizes an oil pump driven by the rotor to produce oil pressure to actuate the by-pass valve and a designed leak in the circuit reduces the oil available to actuate the valve to open the by-pass if the rotor speed is below a preselected amount. That arrangement combines rotor speed sensing and valve actuation.

An alternate arrangement utilizes a pivotable weight that the orbital action of the rotor displaces to actuate a servo valve to control mud flow to actuate the by-pass actuation piston to control the motor by-pass circuit. The mass of the pivotable weight and the strength of a mass centering spring comprise a motor speed sensing means.

By selection of apparatus disclosed, the motor by-pass control valve can direct by-passed drilling fluid through a bore in the rotor or through the housing wall directly to the well annulus. The rotor bore route dumps the by-passed fluid below the motor power generating structure. The rotor bore in motors now operating opens within the motor above the drill head.

To reset the system, to start the motor and close the by-pass, the drill string can be lifted to relieve torque drag on the drill head. The motor will normally restart and motor rotation will close the by-pass and drilling can continue.

Signals, as defined herein, comprise movement of elements or change in conditions, such as fluid flow resistance, initiated to cause a preplanned response action at a remote place. The change in fluid flow resistance at a down hole location, to cause a change in pressure at a surface location, for the purpose of indication that a down hole condition has changed is a signal. This is anticipated by and is within the scope of the claims. That definition of signals is not contrary to the general understanding of the definition used by those skilled in the art involved.

It is an object of this invention to provide apparatus to sense motor rotation and produce an output signal to a valve actuator to open a controlled motor by-pass drilling fluid channel when the motor speed is less than a preselected amount.

It is another object of this invention to close a motor by-pass fluid channel when sensed motor speed exceeds a preselected amount.

It is yet another object of the invention to detect the orbiting of the rotor centerline about the housing centerline to sense the causative rotor rotation.

These and other objects, advantages, and features of this invention will be apparent to those skilled in the art from a consideration of this specification, including the attached claims and appended drawings.

DETAILED DESCRIPTION OF DRAWINGS

Figure 4:
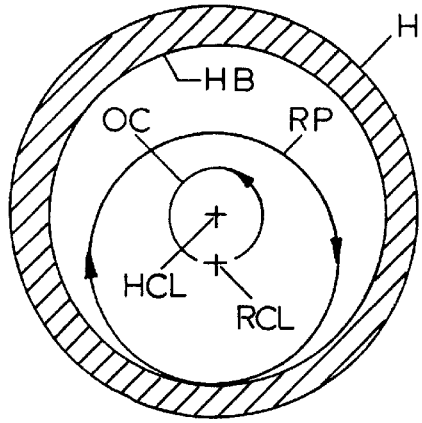
FIG. 4 is a transverse sectional view of a descriptive model used to illustrate the relationship between rotating and orbital movement of a progressing cavity motor rotor relative to the stator.

All apparatus drawings will be better understood by first becoming familiar with the actions illustrated by FIG. 4. A transverse section of a progressing cavity motor would be quite similar to a form of machinery often used for gear reduction. An example could include a seven tooth gear progressing around the inner periphery of a mating eight tooth internal gear. Each excursion about the internal gear would advance the pinion one gear tooth. Eight excursions would produce one rotation of the pinion about its axis of rotation. The eight excursions would carry the axis of the pinion around the axis of the annular gear eight times. FIG. 4 does the same thing with a wheel rolling around the periphery of a bore.

In FIG. 4 housing H, with bore HB, has a roller R with periphery RP rolling around the periphery of bore HB. The roller rotates clockwise and its centerline RCL moves about the housing centerline HCL in a counter clockwise direction. Centerline RCL moves in the circle OC. By selective connection, the roller can be caused to drive a shaft clockwise at the roller rotational speed. By a different form of connection, the shaft can be caused to rotate counterclockwise at the orbital rate of centerline RCL. To subscribe to the gear example the roller would have a diameter seven-eighths the diameter of the bore of the housing. The orbital rate is eight times the rotor rotation rate.

A typical progressing cavity motor has seven lobes on the rotor and eight mating inner lobes on the stator. The cited motor typically runs at two hundred rpm delivered from the rotor, through a universal joint system, to a drill head. The speed of the orbital movement, in this case, is sixteen hundred rpm. As will be described herein, apparatus of this invention can react to either or both rotor and orbital speeds.

Figure 1:
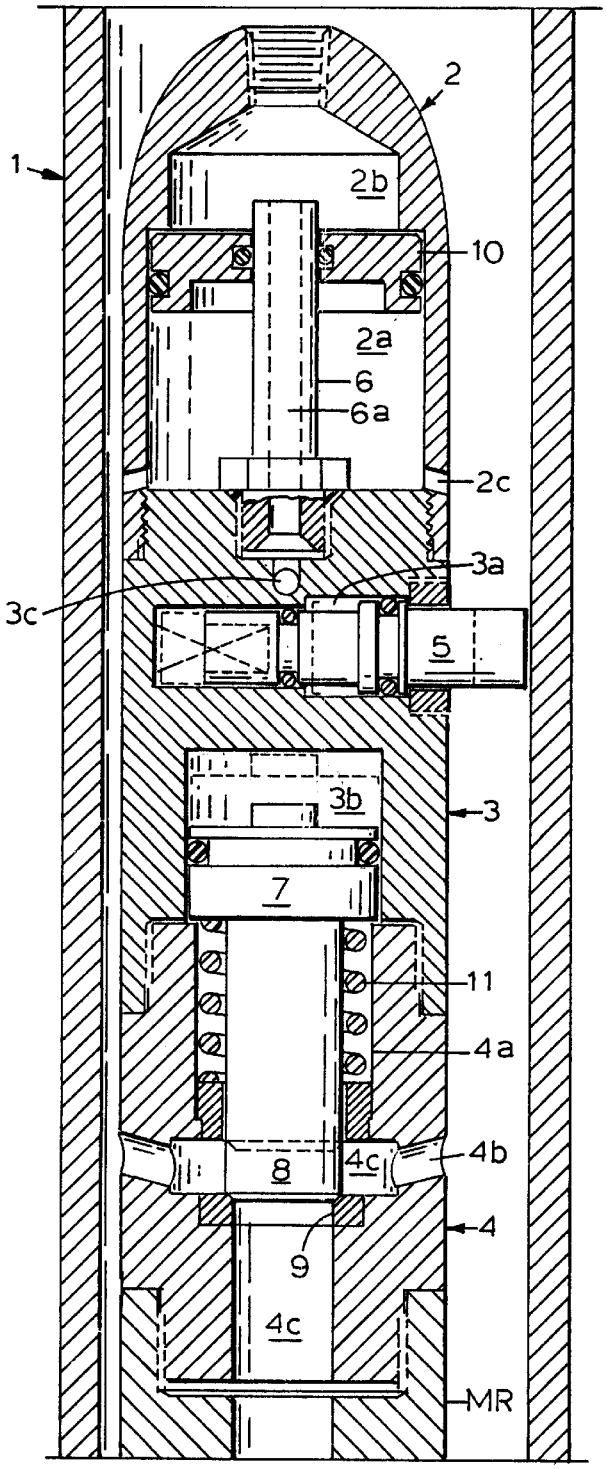
FIG. 1 is a side view, mostly cut away, of one form of the apparatus of the invention.
Figure 2:
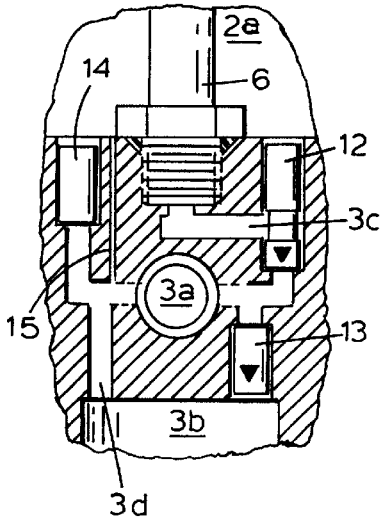
FIG. 2 is a fragmented view, taken along the centerline of the apparatus of FIG. 1, and viewed along the centerline of the pump plunger.

FIGS. 1 and 2 represent a version of the apparatus that enables the sensor to receive input from both the orbital movement of the rotor and the rotation of the rotor. The housing 1 is a serial element of a drill string with means at both ends (not shown) for attachment to drill string elements. A drilling motor of the progressing cavity type is connected to the lower end of housing 1. The apparatus is mounted directly on top of the motor rotor MR. Pump plunger 5 engages the inner wall of the housing and slidingly moves along the periphery of the wall. Inside cover 2, chamber 2*b* contains 11 oil separated by piston 10 from the mud filling chamber 2*a*. Mud is admitted through hole 2*c*. Piston 10 slides up and down in the bore of the cover to function as a reservoir and hydrostatic compensator.

Oil from chamber 2*b* feeds the pump through bore 6*a* in standpipe 6, channel 3*c*, and check valve 12 into pump displacement chamber 3*a*. Output from the pump flows through check valve 13 to the actuating cylinder 3*b* to move piston 7 downward. Bypass valve poppet 8 is attached to the piston 7 and moves down to close by-pass orifice 9, and the by-pass valve is closed for normal motor operation.

Pump pressure is limited by relief valve 14 which drains excess flow back to chamber 2*a* by way of channel 3*d*.

The pump plunger responds to any change between the rotor centerline, along the radial line of movement of the pump plunger, and the housing centerline and, therefore has a pumping action driven by both the orbital movement and the rotor rotation.

When the motor approaches a stall speed, leak 15 drains oil from the chamber 3*b* faster than the pump replaces the oil and spring 11 moves piston 7 upward to open the by-pass valve. This is the speed sensing function. Once the by-pass valve begins to open, the overloaded motor stalls immediately. By-pass valve capacity needs to be large enough for the pressure change at the standpipe in the mud stream, at the surface, to alert the driller that the change has taken place. That is a signal function. The bit load can then be reduced to restart the motor, or other corrective action can proceed.

The rotor on motors most likely to utilize the apparatus has a bore down the center to open just above the motor output shaft.

Figure 3:
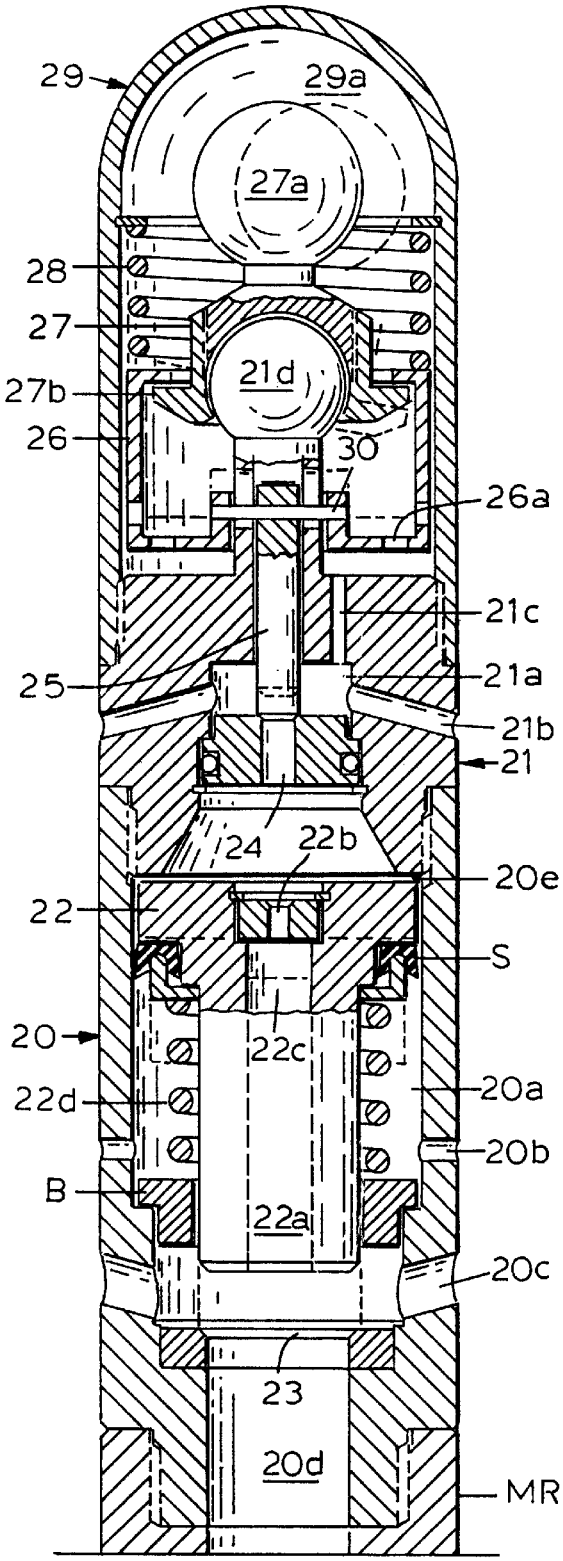
FIG. 3 is a side view, mostly cutaway, of an alternate form of the invention that is mud flooded and mounts on the rotor of a motor without contact with the motor housing.

FIG. 3 represents a form of the apparatus that is mounted on the motor rotor and has no connection to, or contact with, the housing. This form is actuated by the orbital movement of the rotor. Lower block 20 is threadedly connected to the rotor. The body includes block 20 and threadedly connected valve block 21, and cover 29. Pivot ball 21*d* is rigidly mounted on valve block 21 and supports tilt assembly 27 which includes mass 27*a*. Assembly 27 can pivot and rotate about ball 21*d*. When the motor is not rotating, spring 28 pushes lift basket 26 down and lift skirt 27*b* is made level, centering mass 27*a*. Orbital movement of the rotor, when the motor is running, produces a lateral centerline acceleration and the ball 27*a* moves laterally to tilt assembly 27 about the center of ball 21*d*. That lifts the basket and opens the servo valve. In combination, the mass of the ball 27*a* and the centering spring strength quantifies the rotor speed that opens the drilling fluid by-pass channel.

Lift basket 26 is not free to bounce up and down. Holes 26*a* allow mud to slowly move to allow the basket to move slowly.

When the mass is centered and the lift basket is in the low positions shown, pin 30 moves the pilot poppet 25 down to engage orifice 24 to close the pilot valve channel. When the mass is displaced by orbital movement the basket 26 is lifted to move the pilot poppet up to open the pilot valve channel which includes channel 21*b* which opens to the general mud flow channel between the body shown and the housing. The housing is not shown here but is illustrated in FIG. 1.

Channel 20*d* is common with the usual bore down the center of the rotor MR. The rotor bore is the main by-pass channel for the apparatus and leads past the motor power producing structure to open lower in the motor structure.

When the main by-pass valve is open, drilling fluid flows through holes 20*c* and orifice 23. When the poppet 22*a* closes orifice 23, the pressure in channel 20*d* is that below the motor power producing structure and may be in the range of six hundred psi below mud pressure surrounding the body.

Piston 22 can move downward in chamber 20*a*. Spring 22*d* is not essential to the operation of the valve but prevents chatter. Mud pressure in chamber 20*a* is always higher than that in channel 20*d*, when mud is flowing in the system, but it acts upwardly only on the annular surface of the piston outside the diameter of the poppet 22*a*. When the servo valve (poppet 25 and orifice 24) is open the pressure in chamber 20*e* is between the pressure in channel 20*d* and the pressure outside the general body. Pressure at channel 21*b* and 20*c* is essentially the same. Pressure in chamber 20*e* is determined by the relative sizes of orifices 22*b* and 24.

The principle of the servo valve and piston actuated main by-pass valve is generally the same as that governing the operation of most of the MWD mud pulse signal generators now in field operation. It should be noted that the poppet 22*a*, in the vicinity of the orifice 23 causes the pressure in channel 22*c* to be about the same as that in channel 20*d*. The velocity of mud moving across the lower end of poppet 22*a* causes the similarity of those pressures. Of course, too much distance between the poppet and orifice would weaken that effect. The upper travel limit of the poppet 22*a* is, therefore, controlled as shown. In pulsers, spring 22*d* is often used atop the piston in chamber 20*e,* mainly to shorten the stroke of the poppet 22*a* to speed up pulse generation rate.

This form of the apparatus is mud flooded, with channel 21*c* situated to reduce turbulence on basket 26. Seals S and bearings B provide easily replaced expendable parts.

FIGS. 5 through 8 represent apparatus capable of sensing motor speed and opening a by-pass channel through the housing wall when motor speed is below a selected amount. In FIG. 1 a crank is used to allow the orbital movement of the rotor to provide rotation to provide pump driven oil pressure to close the by-pass valve. When the motor approaches stall, a leak is provided in the hydraulic circuit to drain fluid from the valve actuating cylinder to permit the spring loaded by-pass valve to open.

Housing 40 is attached to the motor body, or is part of the extending motor body. Body 41 contains most of the apparatus, is supported in the housing by web 40*b,* and is surrounded by drilling mud flow annulus 40*a.*

As previously described herein the motor rotor MR is always off center in the housing, and has rotor centerline RCL which orbits the body centerline which is also the housing centerline HCL. An oil pump 42 is rotationally driven by crank 43*b* which rotates pump shaft 43*a.* The crank has journal 43*c* rotationally situated in bearing B1 in adapter 48 attached to the motor rotor.

Drilling fluid to be by-passed enters the body through channels, one shown as 41*c,* passes through orifice 47 into chamber 41*a* and flows to the well annulus outside the housing by way of port 41*b.*

The mud flow by-pass is closed, when the motor is running, when oil pressure in cylinder 42*h* causes piston 46 to overcome spring 46*b* and force poppet 46*a* to engage orifice 47.

When pump 42 is turned by the motor oil is drawn from the reservoir inside the membrane, usually a bellows, 44. The pump discharge passes through channel 41*f* to cylinder 41*h* to move the piston 46. Oil pressure is limited by relief valve 45 which dumps oil back to the reservoir. Leak L returns oil back to the reservoir to drain oil from below the piston when the pump output falls below a preselected amount. That is the speed sensing function. The actuation function occurs when the leak lowers poppet 46*a* and opens the drilling fluid by-pass. The drilling fluid by-pass is sized to cause a noticeable reduction in pressure in drilling fluid pressure at the standpipe at the surface.

When piston 46 moves up, oil passes through port 46*c* into channel 41*k* and back to the reservoir through channel 41*j.*

Drilling fluid fills chamber 41*e,* outside the membrane 44, entering the chamber by way of port 49 which opens to the mud flow annulus 40*a.*

Figure 7:
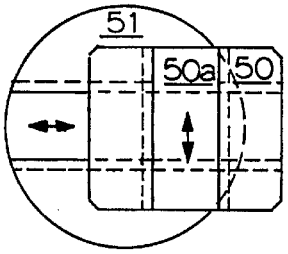
FIG. 7 is a top view illustrating the cross slide arrangement of an Oldham coupling usable on the apparatus of FIG. 5.
Figure 8:
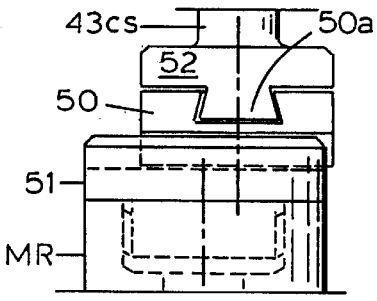
FIG. 8 is side view of an Oldham coupling assembly that can be used to replace the crank drive of the apparatus of FIG. 5

When it is preferred to drive pump 42 by the rotation of the rotor about its own axis RCL, the Oldham coupling of FIG. 8 may be used. This is a familiar coupling to all experienced in the art of machine construction. Coupling element 52 is mounted on a pump shaft shown as 43*cs.* Dovetail slides are transversely situated as shown in FIG. 7. Element 50 couples element 51, which is an adapter for the top of the motor rotor MR, and element 52. The slot 50*a,* and the mating dovetail tang are duplicated in coupling elements 50 and 51. The transverse slots prevent the orbital movement from being transmitted to shaft 43*cs.* The same action can be accomplished by a pair of universal joints spaced axially by a shaft.

The form of apparatus illustrated by FIGS. 9, 10, 11, and 12 is to be fitted on the lower portion of the apparatus of FIG. 3. All above the orifice 24 of FIG. 3 is replaced by the apparatus of FIG. 9. This apparatus responds to the orbital action of the motor rotor.

Housing 30 is part of the drilling motor body, or is an attached extension. Spider 30*b* holds the bearing 30*c* on the housing centerline and crank pin 32*d* rotates therein. Crank 32*a* turns shaft 32*b* to rotate shear drive impeller 32*c.* Drilling fluid fills the space between impeller 32*c* and shear reaction stator 33*a.* Stator 33*a* rotates shaft 33*b* a limited amount. Shaft 33*b* turns cam head 33*c.* Pilot valve poppet 36 has a square shape for non-rotational relationship with bore 31*c.* When cam head 33*c* rotates, cross pin 35 moves in cam slots 33*f* to raise or lower the poppet. The poppet 36 cooperates with orifice 24 of FIG. 3 to perform the servo valve function described in conjunction with FIG. 3.

Spring 34 acts between body portion 31 and the cam head 33*c,* by way of anchors 31*f* and 33*e,* to return the assembly 33 to the starting position when rotation of shaft 32*b* no longer provides the fluid shear feature needed to overcome the spring. The starting position lowers the poppet 36 to close the servo valve. The cam head can rotate about thirty degrees when driven by the shear action of the impeller 32*c* and when driven that amount the poppet is lifted to open the servo valve. An open servo valve closes the drilling fluid by-pass and a closed servo valve opens the drilling fluid by-pass valve, as described for FIG. 3.

Drilling fluid flows down the annular channel 30*a,* and is admitted to chamber 31*a* by port 31*g.* Poppet 36 is loose fitting in bore 31*c* and drilling fluid moves therethrough to fill chamber 31*b.*

Reaction stator 33*a* and impeller 32*c* have fluid spin chambers formed of opposing arcuate grooves 32*d* and 33*d.* Twelve chambers are shown but the viscosity of drilling fluid in the particular use dictates the number of spin chambers needed. In some fluids, three chambers may be enough. Spin chambers are likely to be one inch in length. To reduce transferred torque to the stator, the length of the rotor alone can be changed.

Figure 5:
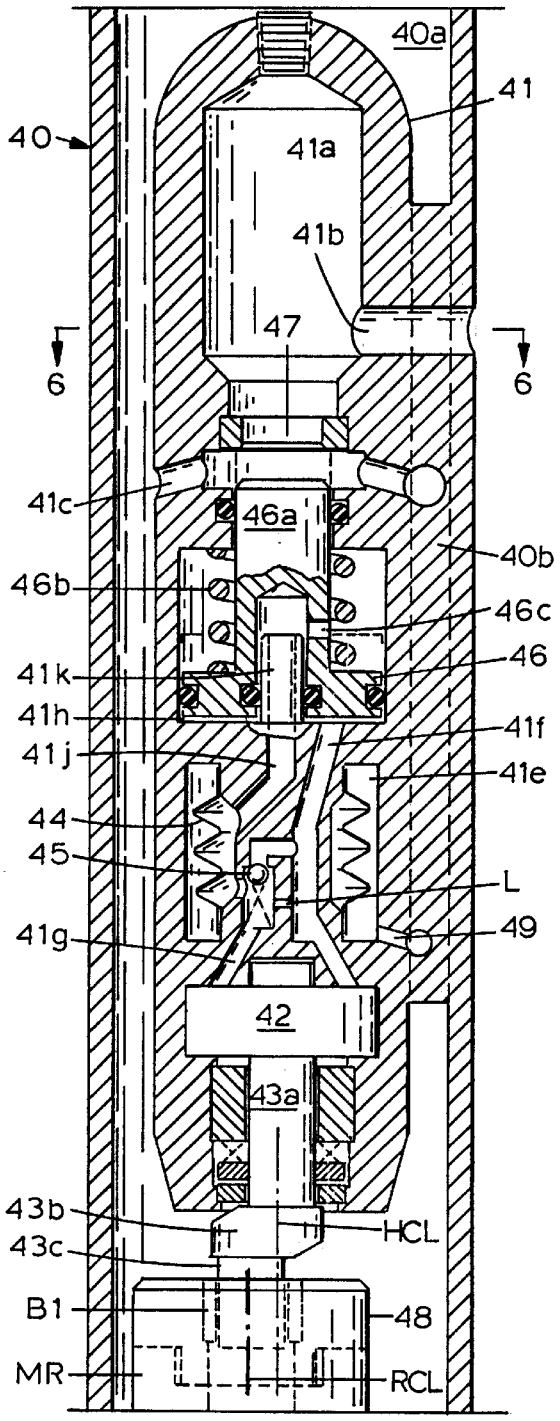
FIG. 5 is a side view, mostly cut away, of an alternate form of the invention which is mounted on the motor housing centerline, driven by the motor rotor, and by-passes drilling fluid through the housing wall.
Figure 6:
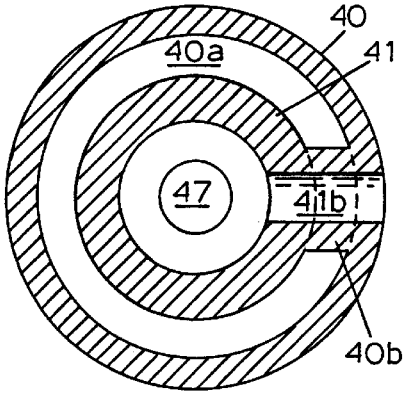
FIG. 6 is a sectional view taken along line 6—6 of FIG. 5.
Figure 9:
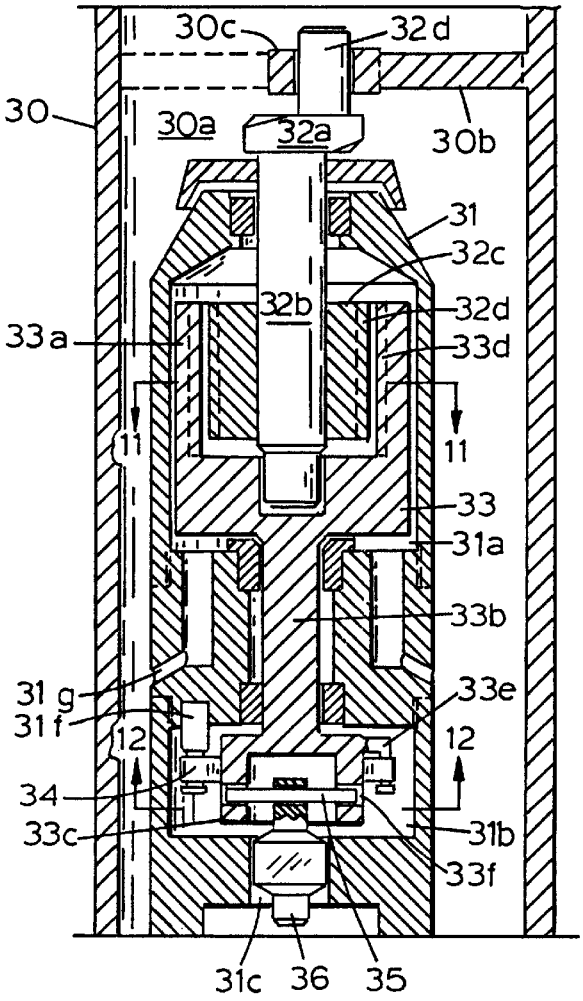
FIG. 9 is a side view, mostly cut away of an alternate form of the speed sensing portion to be used with the actuating portion of the apparatus of FIG. 3.
Figure 11:
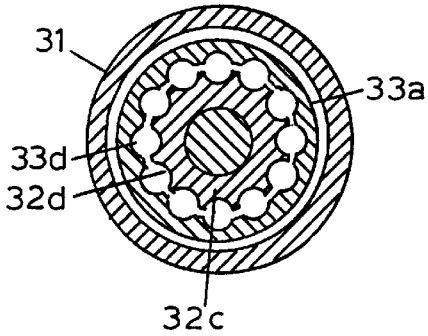
FIG. 11 is a sectional view taken along line 11—11 of FIG. 9
Figure 12:
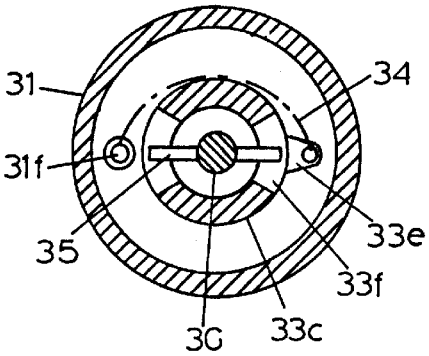
FIG. 12 is a sectional view taken along line 12—12 of FIG. 9
Figure 10:
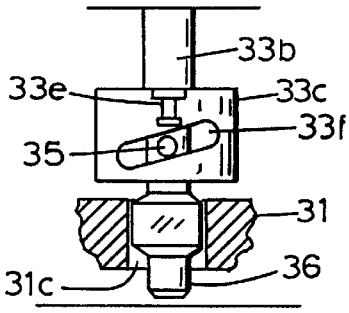
FIG. 10 is a fragmented side view of part of FIG. 9.

The apparatus of FIG. 9, in conjunction with the lower portion of the apparatus of FIG. 3, can be turned upside down, mounted in the manner shown by FIG. 5 to direct the by-passed drilling fluid through the housing wall. In that arrangement the crank pin 32*d* will be mated with, and driven by, the rotor as shown in FIG. 5. That arrangement avoids the necessity for a sealed, oil filled, enclosure. It will perform the finction of the apparatus of FIG. 5. Such an arrangement responds to orbital movement of the rotor.

All crank driven, or Oldham driven versions can be used on turbodrills with rotors that do not have orbital movements. The top of the turbodrill rotors, if driving cranks, will have crank driving bearings that are eccentrically positioned on top of the rotors.

Speed sensing by use of a hydraulic pump in conjunction with a designed leak in the pump output circuit can be accomplished by selection of a pump with intrinsic leakage. Such pumps will produce hydraulic pressure in proportion with their driven speed. Such outputs can be paired with spring resisted hydraulic cylinders such that they move to actuate drilling fluid by-pass control valves only when the motor speed is above, or below, a preselected speed. This is anticipated by and is within the scope of the claims.

In well bores of significant depth, the hydrostatic head is such that there is little or no cavitation at the usual operational pressures. That means that the vacuum at the intake side of the pump is just as effective in operating a hydraulic cylinder as the output or pressure side of the pump. That is anticipated by and is within the scope of the claims.

Turbodrills are not normally damaged by fluid flow when the rotors are stalled but drilling efficiency suffers. In some coring operations, the turbodrills are required to operate at design speed to avoid damage to the coring machinery. The greatest demand for the apparatus of the invention, at present, is for use on positive displacement motors. At present, the only positive displacement motors known to be in use are of the progressing cavity design, with rotors that have orbital movement of the rotor centerline about the housing centerline. Positive displacement motors have been used that have rotors that rotate on stable axes that are parallel to the housing centerline. This invention provides structural arrangements that can be used with all known drilling fluid powered motors.

Electrodrills, or drilling motors with electric motors built into drill head driving arrangements can use apparatus of this invention and such use is expected, if such motors have the upper end of the rotor exposed.

From the foregoing, it will be seen that this invention is one well adapted to attain all of the ends and objects herein above set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, I claim:

1. A drilling motor and motor control apparatus for sensing motor stall and for opening a drilling fluid by-pass channel, to divert at least part of the drilling fluid stream that otherwise flows through and provides power for the drilling motor, when the drilling motor rotor speed is less than a preselected amount, the apparatus comprising:

a) a drilling motor, drilling fluid powered and provided with a tubular rotor, with means at both ends for attachment to drilling string components;

b) a housing arranged to function as a serial length element of a drill string extending upward from said drilling motor, and having a generally central opening;

c) rotational speed sensing means, situated in said housing, responsive to said rotational speed of said drilling motor, to produce a first output signal when said motor rotor speed sensed is below said preselected amount;

d) valve actuator means arranged to move in response to said signal;

e) a by-pass valve, responsive to said move, to open in response to said move a valve means; and f) a fluid by-pass channel, associated with said by-pass valve, to divert drilling fluid to reduce the drilling fluid power delivered to said drilling motor.

2. The apparatus of claim 1 wherein said rotational speed sensing means comprises a mass that is urged from a first position to a second position by lateral acceleration forces that result from rotation of said rotor.

3. The apparatus of claim 1 wherein said rotational speed sensing means senses fluid shear forces produced by movement of an element driven by movement of said rotor relative to said housing.

4. The apparatus of claim 1 wherein said rotational speed sensing means is comprised of a hydraulic pump driven by movement of said rotor and said speed is sensed by pressure of oil from said pump diminished by a prepared leak in the pump output.

5. The apparatus of claim 4 wherein said valve actuator means comprises a hydraulic cylinder powered by oil from said pump.

6. The apparatus of claim 5 wherein a spring opposes pressure induced actuation and the spring and leak cooperate to determine the rotor speed at which the by-pass is opened.

7. The apparatus of claim 1 wherein said fluid by-pass channel communicates between said generally central opening and a bore along the general center of said rotor.

8. The apparatus of claim 1 wherein said fluid by-pass channel communicates through the housing wall upstream of said motor, by-passing said motor.

9. Drilling motor control apparatus for use as part of a drilling fluid stream conducting drill string suspended in a well, for controlling the drilling fluid stream admitted to power producing structure of a drilling motor to divert said drilling fluid stream into a motor by-pass bore in the motor rotor when the rotational speed of the rotor is below a preselected amount, the apparatus comprising:

a) a housing arranged to function as a serial length element of said drill string and to conduct the drilling fluid stream from said drill string to said motor;

b) sensor means, mounted on said rotor, to detect said rotational speed of said rotor and to produce an output signal when said speed is below said preselected amount;

c) actuator means, responsive to said signal, to move a valve means;

d) said valve means mounted on said rotor, responsive to said move, to open to by-pass drilling fluid from said housing to said bore in said rotor.

10. The apparatus of claim 9 wherein all functions of said apparatus depend solely upon said rotor and its movements.

11. The apparatus of claim 9 wherein said sensor means comprises a mass that is urged from a first position to a second position by lateral acceleration forces that result from rotation of said rotor.

12. The apparatus of claim 9 wherein said rotational speed sensing means senses fluid shear forces produced by movement of an element mounted on said rotor and driven by movement of said rotor relative to said housing.

13. The apparatus of claim 9 wherein said rotational speed sensing means is comprised of a hydraulic pump driven by movement of said rotor relative to said housing and said speed is sensed by pressure of oil from said pump diminished by a prepared leak in the pump output.

14. The apparatus of claim 13 wherein said valve actuator means comprises a hydraulic cylinder powered by oil from said pump.

15. The apparatus of claim 14 wherein a spring opposes pressure induced actuation and the spring and the leak cooperate to determine the rotor speed at which the by-pass is opened.

16. A method for controlling a rotor equipped drilling fluid powered drilling motor in a fluid conducting drill string in a well by opening a drilling fluid by-pass channel to reduce drilling fluid power driving said drilling motor, the method comprising the steps:

a) sensing motor speed, at the location of said motor, to produce an output signal when the rotational speed of said rotor is below a preselected amount;

b) actuating a valve operating means, in response to said output signal, to open said drilling fluid by-pass channel to direct fluid to the well to by-pass fluid power producing structure of said motor.

17. The method of claim 16 wherein said motor speed is sensed by directly sensing the motor speed from the movement of said rotor relative to said housing.

18. The method of claim 16 wherein said motor speed is sensed indirectly by sensing the orbital rate of said rotor about the centerline of the housing of said motor, said motor being of progressing cavity type.

19. The method of claim 16 wherein said by-pass channel extends along a bore in said rotor.

20. The method of claim 16 wherein said by-pass channel extends from the bore of said drill string above said motor to the well outside the motor.

* * * * *